US009099797B1

(12) United States Patent
Duesterhoeft et al.

(10) Patent No.: US 9,099,797 B1
(45) Date of Patent: Aug. 4, 2015

(54) ELECTRICAL CONNECTOR

(71) Applicant: Tyco Electronics Corporation, Berwyn, PA (US)

(72) Inventors: Scott Stephen Duesterhoeft, Etters, PA (US); Douglas John Hardy, Middletown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/262,214

(22) Filed: Apr. 25, 2014

(51) Int. Cl.

| | |
|---|---|
| ***H01R 4/58*** | (2006.01) |
| ***H01R 4/48*** | (2006.01) |
| ***H01R 4/02*** | (2006.01) |
| ***H01R 4/10*** | (2006.01) |

(52) U.S. Cl.
CPC .. *H01R 4/58* (2013.01); *H01R 4/02* (2013.01); *H01R 4/10* (2013.01); *H01R 4/4809* (2013.01)

(58) Field of Classification Search
CPC ..... H01R 2103/00; H01R 9/0518; H01R 13/506; H01R 13/516
See application file for complete search history.

(56) References Cited

U.S. PATENT DOCUMENTS

| | | | | |
|---|---|---|---|---|
| 6,287,144 | B1 * | 9/2001 | Baffert | 439/578 |
| 6,679,728 | B1 * | 1/2004 | Huang et al. | 439/579 |
| 2004/0137790 | A1 * | 7/2004 | Lee et al. | 439/582 |
| 2009/0017678 | A1 * | 1/2009 | Meier et al. | 439/582 |
| 2009/0186522 | A1 * | 7/2009 | Henningsen | 439/582 |

OTHER PUBLICATIONS

Tyco Electronics, Section Catalog 1308073-1; Issued Dec. 2009; Main Catalog 1654400-1; Chapter 7—Issued Mar. 2010; pp. 7/2-7/5.

* cited by examiner

*Primary Examiner* — Gary Paumen

(57) ABSTRACT

An electrical connector includes a housing, a first contact, and a second contact. The housing has a first segment oriented transverse to a second segment, and a cavity extending through the first and second segments. The first contact is received in the cavity within the first segment. The second contact is received in the cavity within the second segment, and is oriented transverse to the first contact. A mating end of the first contact includes a cap and at least one deflectable arm that define an attachment region therebetween. A mating end of the second contact includes a bulb that is received in the attachment region to mechanically and electrically connect the mating ends. The at least one deflectable arm engages a proximal portion of the bulb, and the cap engages a distal portion of the bulb to retain the bulb in the attachment region.

20 Claims, 6 Drawing Sheets

ELECTRICAL CONNECTOR

BACKGROUND OF THE INVENTION

The subject matter herein relates generally to electrical connectors that provide a signal path along right angles or other transverse angles.

Some electrical connectors are right angle connectors with mating and terminating ends that are oriented generally perpendicular to one another. As opposed to in-line electrical connectors, the right angle connectors are configured to provide a signal path through a bend or corner in a housing. Right angle connectors may be advantageous over linear connectors in certain applications, such as if there is limited clearance in the surrounding environment to load a mating plug in-line with the connector. However, right angle connectors may be complex and costly to design, manufacture, and assemble. It is difficult to maintain the impedance of such connectors between the mating and terminating ends as the signal path turns 90°, for example, within the connector housing. Additionally, some right angle connectors do not enable automated manufacturing. For example, in some existing right angle connectors, a center contact is inserted into the connector housing and then bent 90° manually using a tool in order to convey the signal path through the right angle corner. This manual assembly process is slow, and the manual bending may damage the center contact.

In other existing right angle connectors, two separate contacts are loaded within the right angle housing and are configured to connect with each other within the corner or bend of the housing to provide a signal path through the housing, instead of bending a single contact through the corner. For example, a first contact may have a pin and a second contact may have a double back socket, where the contacts connect when the pin is pushed between two opposing double back beams. The double back beams engage and retain the pin by an interference fit. For example, each double back beam forces the pin towards the other beam. But, the friction caused by the interference fit is the only force that prohibits the pin from moving relative to the socket. Therefore, during operation of the connector, vibration or other forces on the connector may cause the pin to slide relative to the socket, which at best decreases the electrical performance of the connector and at worst may cause the pin to back out of the socket altogether, breaking the signal path through the connector. Another problem with pin and double back socket connections is that the distal tip of the pin extends at least partially beyond the socket and creates an electrical stub. During operation of the connector, at least some of the electrical signal may be diverted through the distal tip of the pin instead of along the signal path, producing an antenna effect that potentially could broadcast a signal from the connector (although the connector shielding would prohibit signal transmission therethrough). The diversion of the electrical signals through the distal tip of the pin significantly reduces the electrical performance of the right angle connector, and the issue only increases as the signals are transmitted at higher frequencies. For example, the electrical performance of the connector may be much more degraded due to the antenna effect with radio frequency (RF) signals transmitted at higher frequencies of around 4-6 gigahertz (GHz) as opposed to RF signals transmitted at a lower frequency of about 2 GHz. A need remains for an electrical connector that provides effective electrical performance along a right angle or other transverse angle, especially when used to transmit electrical signals over higher frequencies.

BRIEF DESCRIPTION OF THE INVENTION

In an exemplary embodiment, an electrical connector includes a housing, a first contact, and a second contact. The housing has a first segment and a second segment oriented transverse to the first segment. The housing defines a cavity extending through the first and second segments between a distal end of the first segment and a distal end of the second segment. The first contact has a mating end and a terminating end. The first contact is received in the cavity within the first segment of the housing. The second contact has a mating end and a terminating end. The second contact is received in the cavity within the second segment of the housing. The mating end of the second contact is configured to mechanically and electrically connect to the mating end of the first contact within the cavity. The second contact is oriented transverse to the first contact within the cavity. The mating end of the first contact includes a cap and at least one deflectable arm that define an attachment region therebetween. The mating end of the second contact includes a bulb that is received in the attachment region as the mating ends of the first and second contacts are connected. The at least one deflectable arm engages a proximal portion of the bulb, and the cap engages a distal portion of the bulb to retain the bulb in the attachment region.

In an exemplary embodiment, an electrical connector includes a housing, a center contact, and a cable contact. The housing has a first segment and a second segment oriented transverse to the first segment. The housing defines a cavity extending through the first and second segments between a distal end of the first segment and a distal end of the second segment. The center contact has a mating end and a terminating end. The center contact is received in the cavity within the first segment of the housing. The terminating end is configured to terminate to a mating contact of a mating connector. The cable contact has a mating end and a terminating end. The cable contact is received in the cavity within the second segment of the housing. The terminating end of the cable contact is terminated to a conductive core of a cable. The mating end is configured to mechanically and electrically connect to the mating end of the center contact within the cavity. The cable contact is oriented transverse to the center contact within the cavity. The mating end of the center contact includes a cap and at least one deflectable arm that define an attachment region therebetween. The mating end of the cable contact includes a bulb that is received in the attachment region as the mating ends of the center and cable contacts are connected. The at least one deflectable arm engages a proximal portion of the bulb, and the cap engages a distal portion of the bulb to retain the bulb in the attachment region.

DETAILED DESCRIPTION OF THE INVENTION

Figure 1:
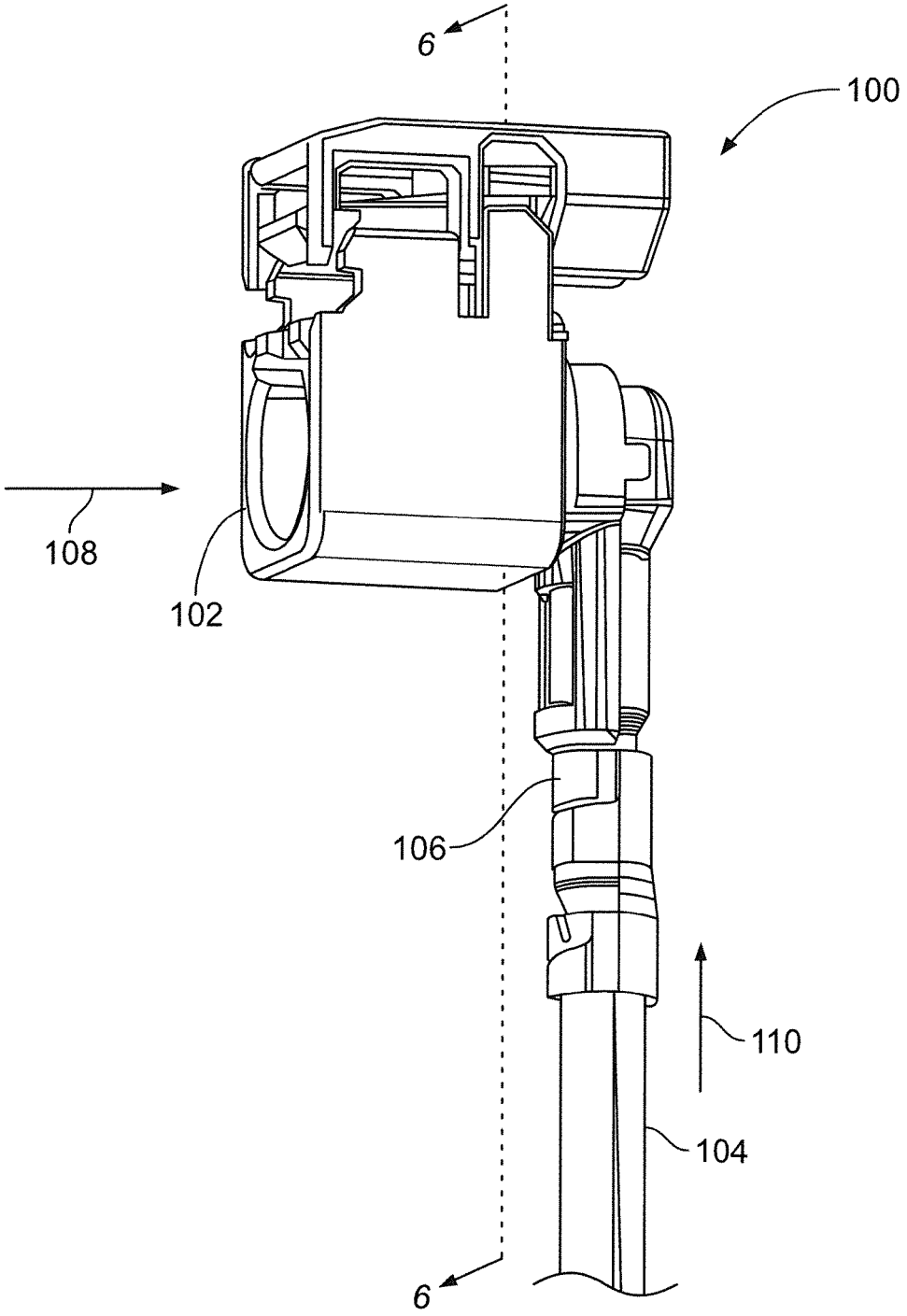
FIG. 1 is a perspective view of an electrical connector formed in accordance with an exemplary embodiment.

FIG. 1 is a perspective view of an electrical connector 100 formed in accordance with an exemplary embodiment. The electrical connector 100 is configured to mate with a mating connector (not shown) at a separable mating end 102 to provide an electrical signal path between the two connectors when mated. The electrical connector 100 may be a plug and the mating connector may be a jack, or vice-versa. The mating connector loads into the electrical connector 100 through the mating end 102 along a loading direction 108. The electrical connector 100 may be terminated to a cable 104 at a non-separable terminating end 106. The cable 104 may be a coaxial cable. The cable 104 loads into the electrical connector 100 at the terminating end 106 along a loading direction 110. In alternative embodiments, the electrical connector 100 may terminate to a printed circuit board (PCB) (not shown) instead of the cable 104. Optionally, the electrical connector 100 may selectively terminate to cables and PCBs.

The electrical connector 100 may have a right angle shape. As used herein, "right angle" generally refers to two planes that are generally perpendicular and/or have a relative angle of approximately 90°, though the angle does not have to be exact. For example, the loading direction 108 of the mating connector (not shown) towards the mating end 102 may be generally perpendicular to the loading direction 110 of the cable 104 towards the terminating end 106. In other embodiments, the electrical connector 100 may have a transverse shape that is other than a right angle. As used herein, "transverse" refers to a relative angle between two planes that is not 180°, such that the two planes are not parallel and would eventually intersect. A right angle is considered a transverse angle. For example, the connector 100 may have an angle between the loading direction 108 of the mating connector and the loading direction 110 of the cable 104 in the range of 35° to 145°, or greater.

The electrical connector 100 may be used in various applications in various industries. For example, the electrical connector 100 may transmit radio frequency (RF) communications in the automotive industry. As an example, the connector 100 may electrically couple an antenna to a radio within an automobile. The electrical connector 100 may be designed to operate at radio frequencies in the megahertz (MHz) and gigahertz (GHz) ranges. In other applications, the connector 100 may be applied in various other industries that utilize RF communications, as known in the art.

Figure 2:
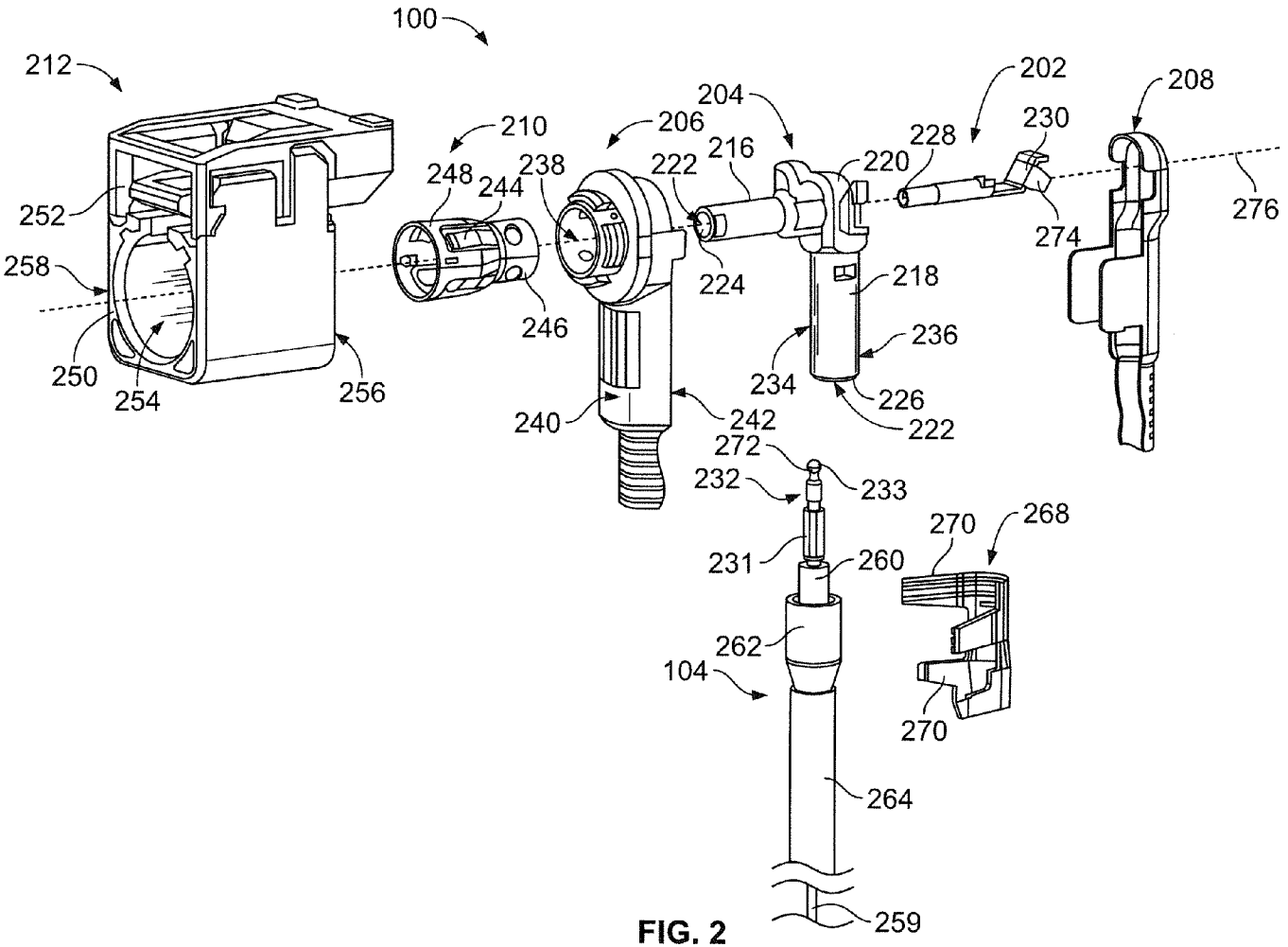
FIG. 2 is an exploded view of the electrical connector of FIG. 1 in accordance with an exemplary embodiment.

FIG. 2 is an exploded view of the electrical connector 100 of FIG. 1. The electrical connector 100 includes at least a housing 204, a first contact 202, and a second contact 232. The housing 204 includes a first segment 216 and a second segment 218. The second segment 218 is oriented transverse to the first segment 216. The second segment 218 extends from the first segment 216 at a corner or bend 220 of the housing 204. Optionally, the housing 204 may be a right angle housing such that the first and second segments 216, 218 are oriented in a right angle relative to each other. The housing 204 defines a cavity 222 that extends through the first and second segments 216, 218 between a distal end 224 of the first segment 216 and a distal end 226 of the second segment 218. The housing 204 may be formed of an electrically insulative material, such as a plastic or another dielectric material. The housing 204 provides electrical insulation for signals transmitted along the contacts 202, 232 of the connector 100. The material and/or thickness of the housing 204 may be selected to tune the impedance of the electrical connector 100.

The first contact 202 is configured to be received in the cavity 222 within the first segment 216 of the housing 204. The first contact 202 includes a terminating end 228 and a mating end 230. The second contact 232 is configured to be received in the cavity 222 within the second segment 218 of the housing 204. The second contact 232 also includes a terminating end 231 and a mating end 233. The mating end 233 of the second contact 232 is configured to mechanically and electrically connect to the mating end 230 of the first contact 202 within the cavity 222. For example, the mating ends 230, 233 may connect within the cavity 222 along the corner or bend region 220 of the housing 204. When the first and second contacts 202, 232 are within the respective first and second segments 216, 218 of the housing 204, the second contact 232 may be oriented transverse to the first contact 202 in an embodiment. The first and second contacts 202, 232 are each formed of an electrically conductive material, such as metal. Optionally, the first and/or second contact 202, 232 may be formed by a stamping and forming process. Alternatively, the first and/or second contact 202, 232 may be formed by a molding process, such as die casting, or another process. Because the contacts 202, 232 mechanically and electrically connect to each other, an electrical signal path is formed through the cavity 222, including across the transverse angle at the corner or bend 220 of the housing 204.

In an embodiment, the first contact 202 may be a center contact, in which the terminating end 228 of the first contact 202 is configured to electrically connect to a mating contact (not shown) of a mating connector (not shown). The second contact 232 may be a cable contact, in which the terminating end 231 of the second contact 232 is configured to electrically connect to a conductive core 259 of the cable 104. Therefore, electrical signals may be transmitted between the mating connector and the cable 104 through the contacts 202, 232 of the electrical connector 100. The mating contact is fixed to the mating connector, the cable contact is fixed to the cable 104, and the center contact acts as a transition element that provides a conductive link between the mating contact and the cable contact. Therefore, a signal may be transmitted between the mating contact and the cable contact even though the mating contact may be oriented transverse to the cable contact.

In an alternative embodiment, the first contact 202 may be a cable contact, and the second contact 232 may be a center contact. For example, the terminating end 228 of the first contact 202 may be electrically connected to a conductive core 259 of a cable 104, and the terminating end 231 of the second contact 232 may be configured to electrically connect to the mating contact (not shown) of the mating connector (not shown). However, for descriptive purposes, the first contact 202 is referred to herein as center contact 202, and the second contact 232 is referred to herein as cable contact 232, unless otherwise specified.

As stated above, the mating end 230 of the center contact 202 is configured to mechanically and electrically connect to the mating end 233 of the cable contact 232. In an exemplary embodiment, the mating end 233 of the cable contact 232 may be a bulb 272 that is configured to be received within a receptacle 274 formed at the mating end 230 of the center contact 202, as described further herein. The terminating end 228 of the center contact 202 may define a socket that is designed to receive and mechanically connect to a male pin, blade, or the like, of the mating contact (not shown). In alternative embodiments, the terminating end 228 of the center contact 202 may include a pin, a crimp barrel, an insulation displacement connector, a solder connector, or the like. The terminating end 231 of the cable contact 232 may define a crimp barrel that is configured to be crimped to the conductive core 259 of the cable 104. Alternatively, the terminating end 231 of the cable contact 232 may define a pin, a socket, an insulation displacement connector, a solder connector, or the like.

In the illustrated embodiment, the electrical connector 100 may also include a front shield 206, a rear shield 208, an outer contact 210, and an outer housing 212. The front shield 206 is configured to receive and provide shielding to a front 234 of the housing 204. As used herein, relative or spatial terms such as "front," "back," "upper," "lower," "left," and "right" are only used to distinguish the referenced elements and do not necessarily require particular positions or orientations in the electrical connector 100 or in the surrounding environment of the electrical connector 100. The front shield 206 defines a cavity 238 that extends through the front shield 206 between a front 240 and a rear 242 of the shield 206. The cavity 238 is sized to receive the first segment 216 of the housing 204 therethrough when the front 234 of the housing 204 is received in the front shield 206. The front shield 206 may be manufactured using a die cast process to provide strength to withstand the stresses of the mounted cable 104 being pulled in various directions. Alternatively, the front shield 206 may be stamped and formed. The rear shield 208 is designed to receive a rear 236 of the housing 204 and provide shielding along the rear 236. The rear shield 208 is configured to couple to the front shield 206 and at least partially surround the second segment 218 of the housing 204. The rear shield 208 may be made of sheet metal that is stamped and formed on a carrier strip for mass production and automated assembly. Alternatively, the rear shield 208 may be die cast, or formed of another molding process.

The outer contact 210 is configured to be electrically connected to an outer mating contact (not shown) of the mating connector (not shown), the outer mating contact being disposed radially around the inner mating contact (not shown). The outer contact 210 may include multiple biased deflectable fingers 244 that retain electrical and mechanical contact with the outer mating contact when the mating connector is coupled to the electrical connector 100. A mounting interface or end 246 of the outer contact 210 may be received within the cavity 238 of the front shield 206 from the front 240. The outer contact 210 also includes a mating end 248 that extends forwards of the front shield 206 and defines a socket for mating with the outer mating contact of the mating connector. The outer contact 210 has a hollow cylindrical shape configured to receive the first segment 216 of the housing 204 (and the center contact 202 within) therein. The first segment 216 extends through the cavity 238 of the front shield 206 and is received within the outer contact 210. The outer contact 210 may be stamped and formed of a conductive material.

The outer housing 212 is configured to couple to the front 240 of the front shield 206 at least partially surrounding the outer contact 210. The outer housing 212 has a mating interface 250 at a front 258 that defines a socket for mating with the mating connector (not shown). The mating interface 250 forms the separable mating end 102 of the electrical connector 100, shown in FIG. 1. The outer housing 212 defines a channel 254 that extends from the socket at the mating interface 250 to a rear 256 of the outer housing 212. The channel 254 is configured to receive the outer contact 210, first segment 216 of the housing 204, and the center contact 202 therein through the rear 256. The outer housing 212 may be manufactured from an electrically insulating material, such as a plastic and/or a composite. The outer housing 212 may include a lock 252 which hooks to the mating connector and supports retention of the mating connector within the mating interface 250 of the housing 212. The lock 252 may include one or more latches, tabs, and the like, to prohibit unintentional disconnection of the mating connector and the electrical connector 100.

The cable 104 may have an inner conductive core 259, a tubular insulating layer 260 surrounding the conductive core 259 along the length of the cable 104, a tubular conducting shield 262 surrounding the insulating layer 260, and an insulating outer sheath or jacket 264 surrounding the conducting shield 262. The cable 104 may be a coaxial cable. The tubular insulating layer 260 and/or the insulating outer jacket 264 may be formed of an electrically insulative dielectric material. The tubular conducting shield 262 may be manufactured as woven or braided metal strands, such as copper. The conductive core 259 may be a conductive metal or metal alloy, including a metal such as copper or silver. The conductive core 259 may be terminated to the cable contact 232 by a crimping process, a soldering process, or the like.

A ferrule 268 may be used to crimp the electrical connector 100 to the cable 104. The ferrule 268 may be stamped and formed on a carrier strip. The illustrated ferrule 268 has an open-barrel shape with at least one crimping arm 270. Alternatively, the ferrule 268 may include a closed-barrel shape. The ferrule 268 is used to mechanically and electrically connect the front and rear shields 206, 208 of the connector 100 to the cable 104, such as by crimping the front and rear shields 206, 208 to the tubular conducting shield 262 of the cable 104 for both electrical and mechanical coupling at the non-separable terminating end 106 (shown in FIG. 1) of the connector 100.

During assembly of the electrical connector 100, the center contact 202, the housing 204, the front and rear shields 206, 208, the outer contact 210 and the outer housing 212 are moved generally along an assembly axis 276 until the components are nested and/or coupled to each other. For example, the center contact 202 may be received in the cavity 222 within the first segment 216 of the housing 204 through an opening (not shown) along the rear 236 of the housing 204 near the corner or bend 220. The housing 204 may then be nested into the front and rear shields 206, 208, which surround the housing 204. Optionally, the shields 206, 208 may couple together. The outer contact 210 is loaded into the cavity 238 of the front shield 206 before or after the housing 204 is nested into the front shield 206. Similarly, the outer housing 212 may be coupled to the front shield 206 around the outer contact 210 prior to or after the housing 204 is loaded into the rear 242 of the front shield 206.

Figure 3:
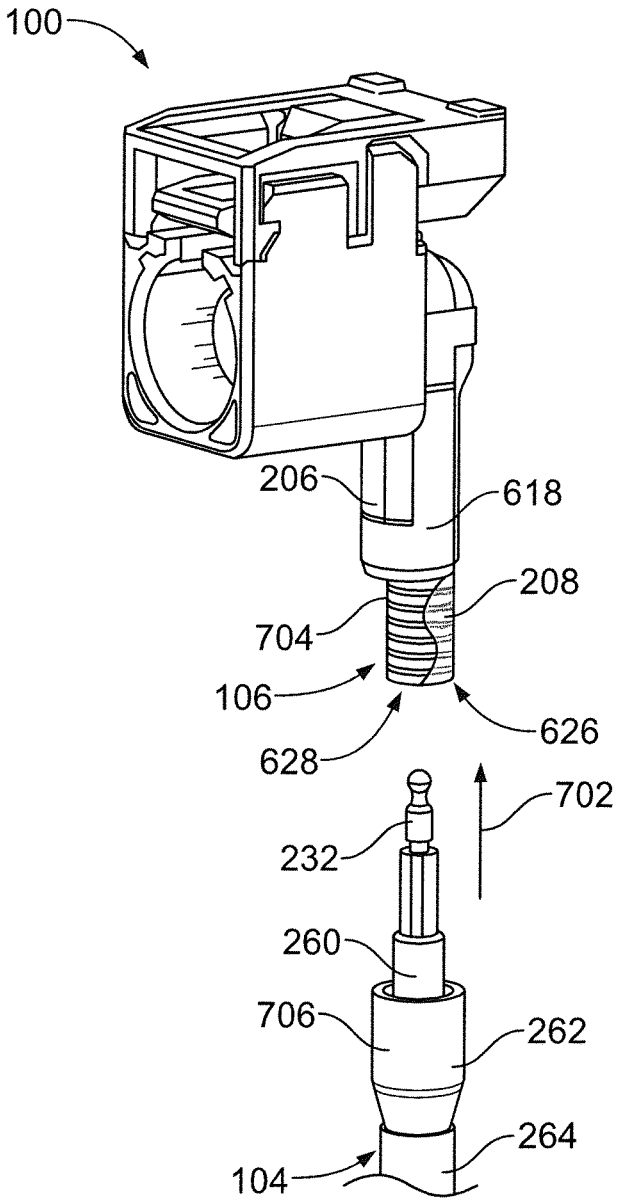
FIG. 3 is a perspective view of the assembly of the electrical connector showing a cable poised for loading.

FIG. 3 is a perspective view of the assembly of the electrical connector 100 showing the cable 104 poised for loading. The front and rear shields 206, 208 may combine to form a mounting portion 704 located along a bottom 626 of the shields 206, 208. The mounting portion 704 is configured to be coupled to the cable 104. The cable 104 is moved in a coupling direction 702 towards the bottom 626 of the shields 206, 208. The cable contact 232 may be inserted through an opening 628 at the bottom 626, and extends into the cavity 222 (shown in FIG. 2) of the housing 204 (FIG. 2) within the second segment 218 (FIG. 2). For example, the cable contact 232 and the insulating layer 260 may be inserted through the opening 628, while the conducting shield 262 and the outer jacket 264 do not enter through the opening 628. The cable 104 may have a braid 706 at a distal portion of the conducting shield 262. The cable 104 may couple to the shields 206, 208 by dressing the braid 706 of the cable 104 around the mounting portion 704, and then crimping the braid 706 to the mounting portion 704 using the ferrule 268. As such, in an embodiment, the center contact 202 (shown in FIG. 2) is pre-loaded into the cavity 222 of the housing 204 within the first segment 216 (FIG. 2) before the cable contact 232 is loaded into the cavity 222 of the housing 204 within the second segment 218 for connecting to the center contact 202.

Figure 4:
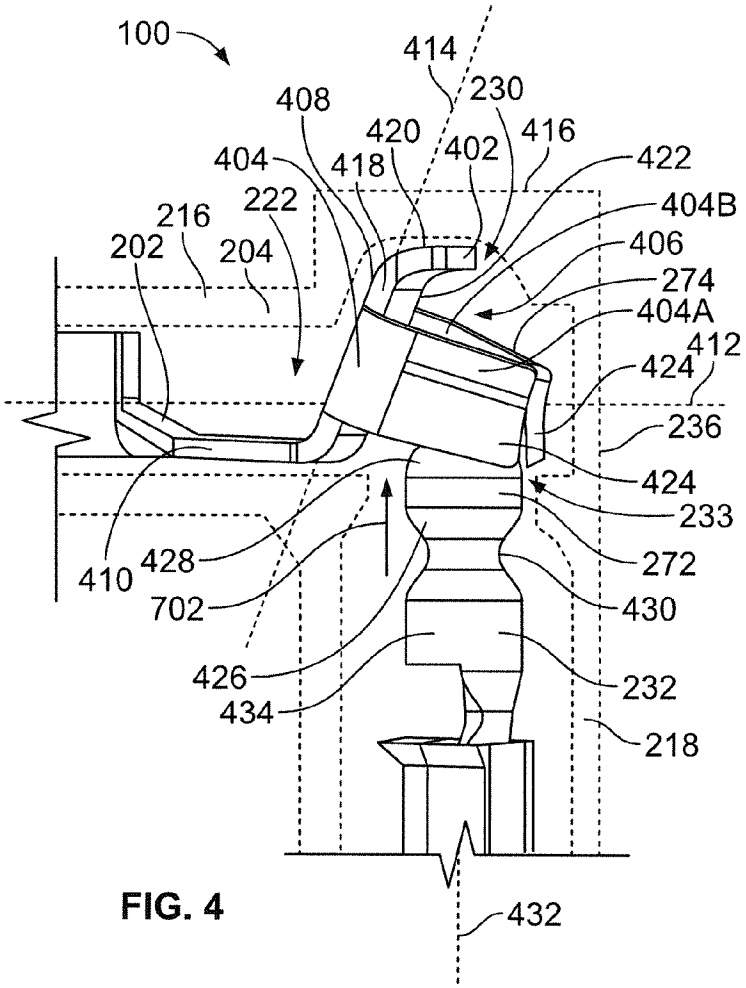
FIG. 4 is a close-up perspective view of a cable contact poised for connecting with a center contact in accordance with an exemplary embodiment of the electrical connector.

FIG. 4 is a close-up perspective view of the cable contact 232 poised for connecting with the center contact 202 within the cavity 222 of the housing 204 in accordance with an exemplary embodiment of the electrical connector 100. For illustrative purposes, the housing 204 is shown in phantom and other components of the electrical connector 100, such as the front and rear shields 206, 208 (both shown in FIG. 2), are not shown. In an exemplary embodiment, the mating end 230 of the center contact 202 forms a receptacle 274 that is configured to mechanically and electrically connect to a bulb 272 at the mating end 233 of the cable contact 232.

The receptacle 274 includes a cap 402 and at least one deflectable arm 404. The cap 402 and the at least one arm 404 define an attachment region 406 therebetween. The attachment region 406 is configured to receive the bulb 272 of the cable contact 232 therein. The receptacle 274 at the mating end 230 also includes a back wall 408. The back wall 408 extends from a body 410 of the center contact 202. The body 410 of the center contact 202 forms the socket or other connector mechanism that couples to the mating contact (not shown) of the mating connector (not shown). The body 410 of the center contact 202 extends along a longitudinal axis 412. The back wall 408 extends from the body 410 along a back wall axis 414 that is transverse to the longitudinal axis 412. For example, the back wall 408 may extend towards a top wall 416 of the housing 204.

In an embodiment, both the cap 402 and the at least one deflectable arm 404 may extend from the back wall 408. For example, the cap 402 extends from a distal end 420 of the back wall 408 along an orientation transverse to the back wall axis 414. The cap 402 may be curved or angled towards the rear 236 of the housing 204. The at least one arm 404 extends from a first side edge 418 of the back wall 408 along an orientation transverse to the back wall axis 414. For example, the at least one arm 404 may extend generally towards the rear 236 of the housing 204. In an embodiment, the at least one arm 404 may extend from the first side edge 418 and curve at least partially towards an opposite second side edge 422 of the back wall 408. In the illustrated embodiment, the center contact 202 includes two deflectable arms 404A, 404B. A first arm 404A extends from the first side edge 418 of the back wall 408, and a second arm 404B extends from the second side edge 422 of the back wall 408. The two arms 404A, 404B curve at least partially towards each other. The attachment region 406 is defined generally between the two arms 404A, 404B and in the space between the arms 404A, 404B and the cap 402. In an exemplary embodiment, the at least one deflectable arm 404 (for example, arms 404A, 404B) includes a flared end 424 that flares radially outward away from the attachment region 406 to accommodate the bulb 272 of the cable contact 232, as described below. In an embodiment, the receptacle 274 at the mating end 230 of the center contact 202 may be formed integral to the body 410 by a stamping and forming a panel of sheet metal.

The bulb 272 at the mating end 233 of the cable contact 232 includes a proximal portion 426 and a distal portion 428. In the illustrated embodiment, both the proximal and distal portions 426, 428 of the bulb 272 are rounded. Optionally, the entire bulb 272 may be spherical, or at least part of the bulb 272 may be cylindrical. The proximal portion 426 extends from a neck 430. The neck 430 may have a diameter that is less than a diameter of the bulb 272. The neck 430 may extend from a body 434 of the cable contact 232. The body 434 of the cable contact 232 forms the crimp barrel or other connector mechanism that fixes to the conductive core 259 (shown in FIG. 2) of the cable 104 (FIG. 2). The body 434 of the cable contact 232 extends along a longitudinal axis 432. The bulb 272 and neck 430 may also extend along the longitudinal axis 432. In an embodiment, the neck 430 may extend from a portion of the body 434 that has a diameter greater than the diameter of the neck 430, such that the mating end 233 of the cable contact 232 forms an hourglass silhouette.

During the assembly of the electrical connector 100, the center contact 202 may be pre-loaded in the cavity 222 of the housing 204 within the first segment 216, and the cable contact 232 may subsequently be advanced through the cavity 222 in the coupling direction 702 within the second segment 218 of the housing 204. In an embodiment, the distal portion 428 of the bulb 272 may engage the flared end 424 of the at least one deflectable arm 404 as the cable contact 232 is moved in the coupling direction 702. The flared end 424 is configured to accommodate the bulb 272 by guiding the bulb 272 into the attachment region 406 as the bulb 272 contacts the at least one arm 404. The force of the bulb 272 on the flared end 424 of the arm(s) 404 may cause the arm(s) to deflect radially outward to permit the bulb 272 to enter the attachment region 406. As the cable contact 232 is further advanced in the coupling direction 702, the bulb 272 is fully received in the attachment region 406. The bulb 272 is fully received in the attachment region 406 when the cap 402 of the center contact 202 engages the distal portion 428 of the bulb 272 and the at least one deflectable arm 404 engages the proximal portion 426 of the bulb 272.

Figure 5:
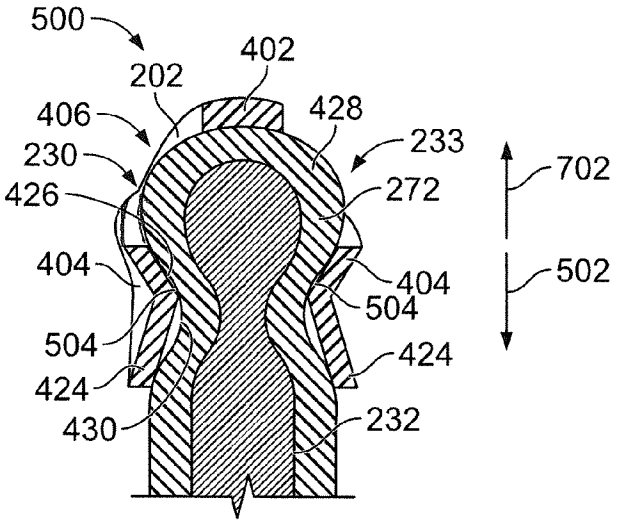
FIG. 5 is a cross-section of a mating interface between a mating end of a center contact and a mating end of a cable contact according to an embodiment of the electrical connector.

FIG. 5 is a cross-section of a mating interface 500 between the mating end 230 of the center contact 202 and the mating end 233 of the cable contact 232. As described in FIG. 4, as the cable contact 232 is moved in the coupling direction 702, the bulb 272 engages the flared end 424 of the at least one deflectable arm 404 and causes the at least one arm 404 to deflect radially outward. The at least one deflectable arm 404 is biased towards the un-deflected position. Since the neck 430 has a smaller diameter than the bulb 272, the at least one deflectable arm 404 is biased towards being received at least partially within the neck 430, since the arm 404 may be un-deflected or at least less deflected when received in the neck 430 (as compared to being engaged by the bulb 272). Therefore, during as the cable contact 232 is advanced in the coupling direction 702, when the bulb 272 moves beyond the at least one deflectable arm 404, the at least one arm 404 may be received at least partially within the neck 430. Optionally, the biasing force on the arm(s) 404 may cause the at least one arm 404 to snap into the neck 430, producing an audible cue that indicates receipt of the bulb 272 in the attachment region 406.

In an exemplary embodiment, when the bulb 272 is received in the attachment region 406, the cap 402 engages the distal portion 428 of the bulb 272. The cap 402 blocks further movement of the cable contact 232 in the coupling direction 702. In addition, the contact of the cap 402 with the bulb 272 provides an electrical signal path between the center contact 202 and the cable contact 232. The at least one arm 404 is received at least partially within the neck 430 and engages the proximal portion 426 of the bulb 272, prohibiting movement of the cable contact 232 in an opposite, uncoupling direction 502 to retain the bulb 272 in the attachment region 406. In an embodiment, the at least one arm 404 includes a ridge 504 that extends radially inward towards the attachment region 406 and is received within the neck 430. The ridge 504, or the portion of the arm 404 above the ridge 504 (for example, towards the cap 402), may engage the proximal portion 426 of the bulb 272. If the cable contact 232 is pulled in the uncoupling direction 502, the ridge 504 (or the portion above the ridge 504) provides a force at least partially in the coupling direction 702 to retain the bulb 272 in the attachment region 406. If the cable contact 232 is pulled with sufficient force in the uncoupling direction 502, the bulb 272 may cause the ridge 504 to deflect radially outward to permit the bulb 272 to exit the attachment region 406. In an exemplary embodiment, the at least one deflectable arm 404 provides constant engagement of the bulb 272 when the bulb 272 is within the attachment region 406, which provides an electrical signal path between the center contact 202 and the cable contact 232. As such, both the cap 402 and the at least one arm 404 may constantly engage the bulb 272 within the attachment region 406.

In an embodiment, the at least one deflectable arm 404 extends at least partially around a perimeter of the bulb 272 when the bulb 272 is within the attachment region 406, which blocks at least some side-to-side movement of the bulb 272. For example, the mating end 230 of the center contact 202 may have two arms 404 that curve towards each other and together surround at least most of the perimeter of the bulb 272. In the illustrated embodiment, the cross-section of the arm 404 may show two different arms 404, or, alternatively, two different portions of a single arm 404.

Figure 6:
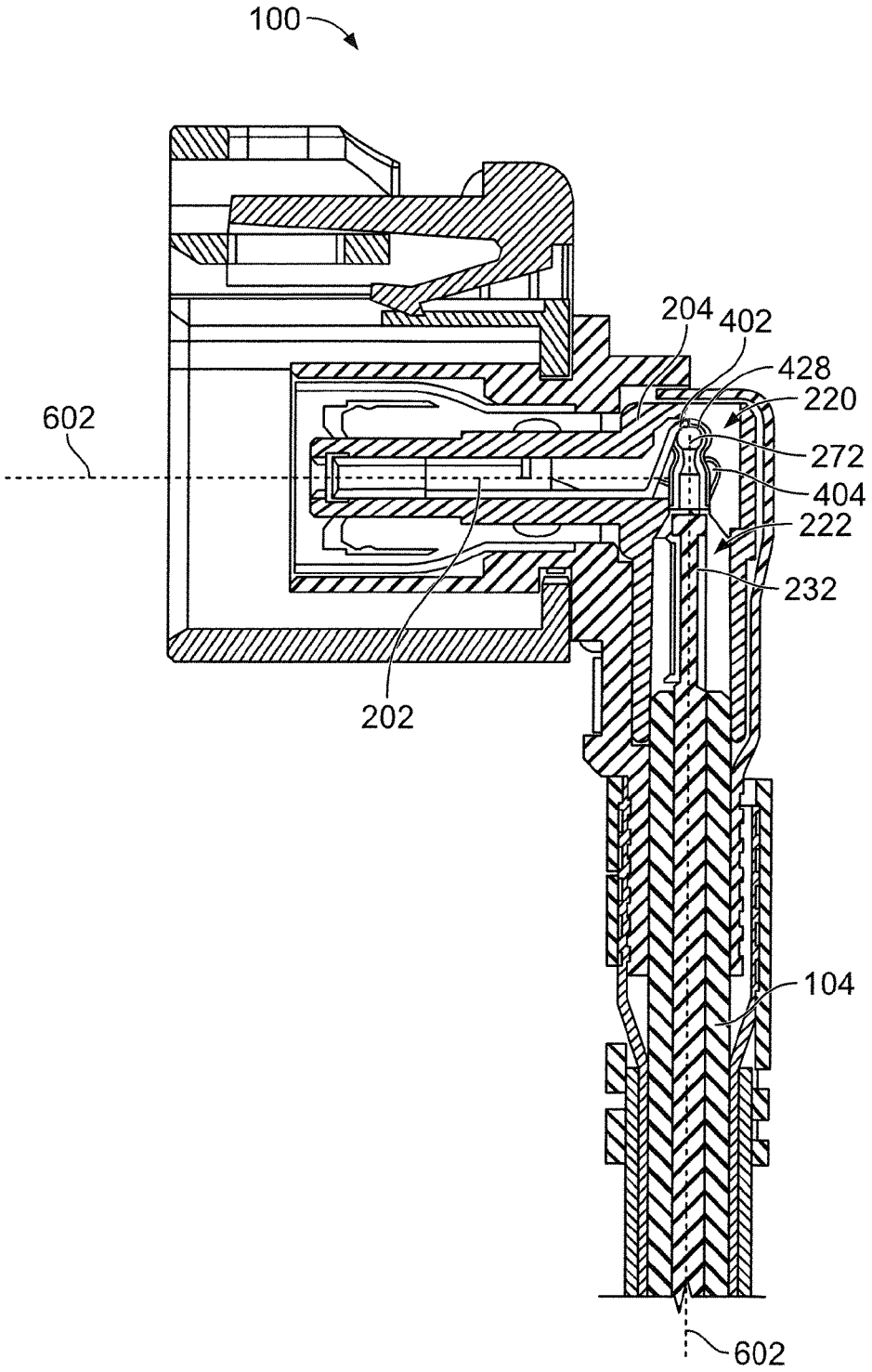
FIG. 6 is a side cross-section of the electrical connector along line 6-6 of FIG. 1.

FIG. 6 is a side cross-section of the electrical connector 100 along line 6-6 of FIG. 1. When the center contact 202 is mated to the cable contact 232, an electrical signal path 602 is formed through the housing 204 within the cavity 222. Due to the electrical connection between the bulb 272 and the cap 402 and/or the at least one arm 404, the signal path 602 traverses the corner or bend 220 of the housing 204, which may have an acute angle, a right angle, or an obtuse angle. The signal path 602 may extend through the attached cable 104, and also through the mating connector (not shown) when coupled to the connector 100. In known right angle electrical connectors, an exposed pin at the angled section may form an electrical stub, producing an antenna effect that reduces the signal quality through the connector. The antenna affect generally increases with frequency, so many right angle connectors have greatly reduced signal quality transmission at frequencies in the range of 3-6 GHz, or more. The electrical connector 100 may reduce the antenna effect because the cap 402 engages the distal portion 428 of the bulb 272, which captures at least some electrical signals that extend to the distal portion 428 of the bulb 272 and guide the signals into the general signal path 602 instead of allowing the bulb 272 to form an electrical stub that broadcasts the signals. As such, the electrical connector 100 may have increased signal performance, even at high frequencies up to 6 GHz or more.

Figure 7:
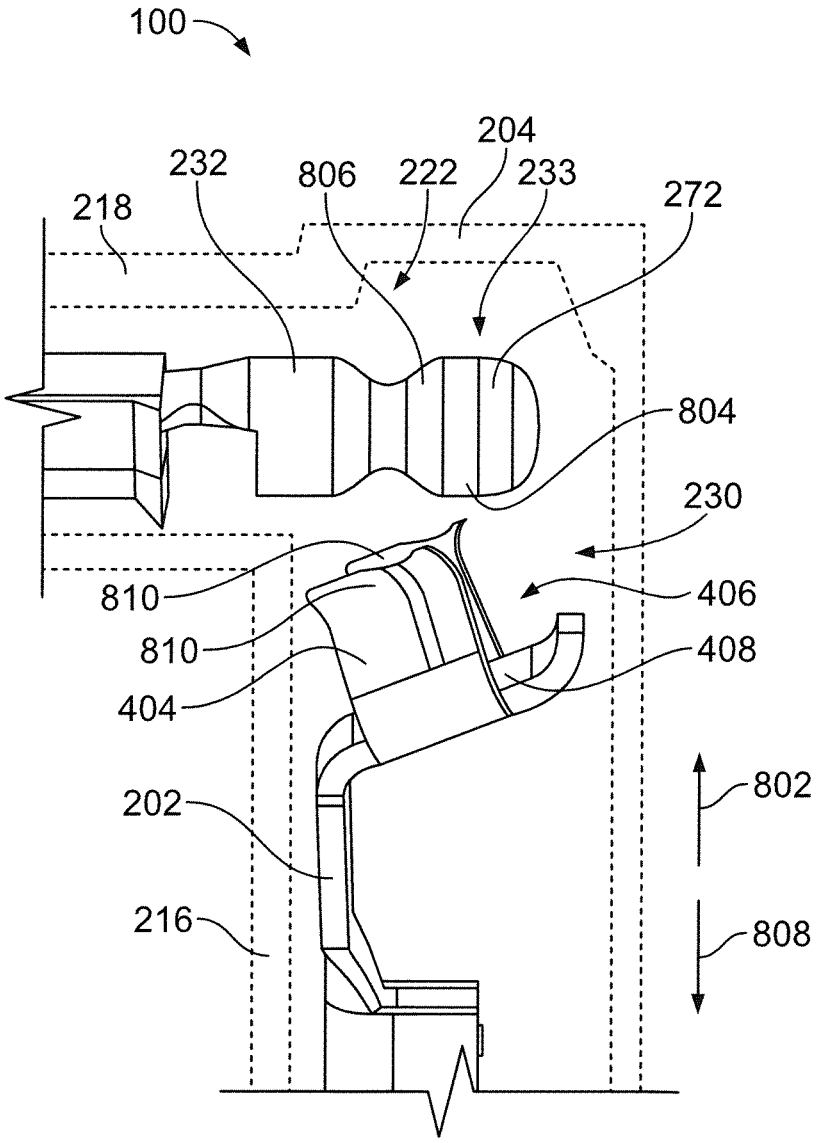
FIG. 7 is a perspective view of an alternative embodiment of the electrical connector.

FIG. 7 is a perspective view of an alternative embodiment of the electrical connector 100. In the illustrated alternative embodiment, the second contact 232 may be a center contact that is loaded into the cavity 222 of the housing 204 within the second segment 218 prior to the first contact 202 being loaded into the cavity 222 within the first segment 216. The mating ends 230, 233 of the first and second contacts 202, 232, respectively, are connected by advancing the first contact 202 through the cavity 222 in a coupling direction 802 until the attachment region 406 receives the bulb 272 of the second contact 232 therein. A first region 804 of the bulb 272 may engage the back wall 408 of the first contact 202 to restrict further movement of the first contact 202 in the coupling direction 802. The at least one deflectable arm 404 of the first contact 202 may have a flared end 810 at a distal end thereof to engage and allow the arm(s) 404 to deflect around the bulb 272. Once the bulb 272 is within the attachment region 406, a second region 806 of the bulb 272 may engage the at least one deflectable arm 404 to restrict movement of the first contact 202 in an opposite, uncoupling direction 808. For example, the at least one deflectable arm 404 may curve at least partially around the bulb 272 such that at least part of the arm(s) 404 engages the second region 806, which may be generally opposite the first region 804.

Optionally, in the illustrated alternative embodiment, the terminating end 228 (shown in FIG. 2) of the first contact 202 may electrically connect to the conductive core 259 (FIG. 2) of the cable 104 (FIG. 2) at the non-separable terminating end 106 (shown in FIG. 1) of the connector 100. The terminating end 231 (FIG. 2) of the second contact 232 may be configured to electrically connect to the mating contact (not shown) of the mating connector (not shown) at the separable mating end 102 (shown in FIG. 1) of the connector 100. As such, the second contact 232 may be a center contact that forms a conductive link between the mating contact of the mating connector and the first contact 202, which is the cable contact of the cable 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a first segment and a second segment oriented transverse to the first segment, the housing defining a cavity extending through the first and second segments between a distal end of the first segment and a distal end of the second segment;

a first contact having a mating end and a terminating end, the first contact received in the cavity within the first segment of the housing; and a second contact having a mating end and a terminating end, the second contact received in the cavity within the second segment of the housing, the mating end of the second contact configured to mechanically and electrically connect to the mating end of the first contact within the cavity, the second contact oriented transverse to the first contact within the cavity, wherein the mating end of the first contact includes a cap and at least one deflectable arm that define an attachment region therebetween, the mating end of the second contact including a bulb that is received in the attachment region as the mating ends of the first and second contacts are connected, the at least one deflectable arm engaging a proximal portion of the bulb and the cap engaging a distal portion of the bulb to retain the bulb in the attachment region.

2. The electrical connector of claim 1, wherein the at least one deflectable arm extends at least partially around a perimeter of the bulb when the bulb is within the attachment region.

3. The electrical connector of claim 1, wherein the proximal portion of the bulb extends from a neck along a longitudinal axis of the second contact, the neck having a diameter less than a diameter of the bulb, wherein the at least one deflectable arm is biased towards being received at least partially within the neck.

4. The electrical connector of claim 3, wherein the at least one deflectable arm includes a ridge that extends radially inward towards the attachment region and is received within the neck when the bulb is within the attachment region.

5. The electrical connector of claim 1, wherein the at least one deflectable arm extends from a back wall at the mating end of the first contact, the back wall oriented along a back wall axis, the at least one arm extending from a side edge of the back wall in an angle transverse to the back wall axis, the cap of the mating end extending from a distal end of the back wall in an angle transverse to the back wall axis.

6. The electrical connector of claim 5, wherein the at least one deflectable arm includes two deflectable arms that extend from opposite side edges of the back wall of the first contact, the two arms curved towards each other and together surround at least most of a perimeter of the bulb when the bulb is within the attachment region.

7. The electrical connector of claim 1, wherein the at least one deflectable arm at the mating end of the first contact includes a flared end that flares radially outward away from the attachment region, the bulb at the mating end of the second contact engaging the flared end of the at least one arm to deflect the at least one arm radially outward to permit the bulb to enter the attachment region as the mating ends of the first and second contacts are connected.

8. The electrical connector of claim 1, wherein the first contact is loaded into the cavity of the housing prior to the second contact, the mating ends of the first and second contacts connected by advancing the second contact through the cavity in a coupling direction until the bulb is received in the attachment region, the cap of the first contact engaging the distal portion of the bulb to restrict further movement of the second contact in the coupling direction and the at least one deflectable arm engaging the proximal portion of the bulb to restrict movement of the second contact in an opposite, uncoupling direction.

9. The electrical connector of claim 1, wherein the second contact is loaded into the cavity of the housing prior to the first contact, the mating ends of the first and second contacts connected by advancing the first contact through the cavity in a coupling direction until the attachment region receives the bulb therein, a first region of the bulb engaging a back wall of the first contact to restrict further movement of the first contact in the coupling direction and a second region of the bulb engaging the at least one deflectable arm to restrict movement of the first contact in an opposite, uncoupling direction.

10. The electrical connector of claim 1, wherein the terminating end of the first contact is configured to electrically connect to a mating contact of a mating connector, and the terminating end of the second contact is configured to electrically connect to a conductive core of a cable.

11. The electrical connector of claim 10, further comprising an outer contact at least partially surrounding the first segment of the housing and an outer housing at least partially surrounding the outer contact, wherein the outer housing has a mating interface defining a socket for mating with the mating connector.

12. The electrical connector of claim 1, wherein the terminating end of the first contact is configured to electrically connect to a conductive core of a cable, and the terminating end of the second contact is configured to electrically connect to a mating contact of a mating connector.

13. The electrical connector of claim 1, wherein the terminating end of at least one of the first contact or the second contact includes at least one of a pin, a socket, a crimp barrel, an insulation displacement connector, or a solder connector.

14. An electrical connector comprising:

a housing having a first segment and a second segment oriented transverse to the first segment, the housing defining a cavity extending through the first and second segments between a distal end of the first segment and a distal end of the second segment;

a center contact having a mating end and a terminating end, the center contact received in the cavity within the first segment of the housing, the terminating end configured to terminate to a mating contact of a mating connector; and a cable contact having a mating end and a terminating end, the cable contact received in the cavity within the second segment of the housing, the terminating end of the cable contact terminated to a conductive core of a cable, the mating end configured to mechanically and electrically connect to the mating end of the center contact within the cavity, the cable contact oriented transverse to the center contact within the cavity, wherein the mating end of the center contact includes a cap and at least one deflectable arm that define an attachment region therebetween, the mating end of the cable contact including a bulb that is received in the attachment region as the mating ends of the center and cable contacts are connected, the at least one deflectable arm engaging a proximal portion of the bulb and the cap engaging a distal portion of the bulb to retain the bulb in the attachment region.

15. The electrical connector of claim 14, wherein the center contact is loaded into the cavity of the housing prior to the cable contact, the mating ends of the center and cable contacts connected by advancing the cable contact through the cavity in a coupling direction until the bulb is received in the attachment region, the cap of the center contact engaging the distal portion of the bulb to restrict further movement of the cable contact in the coupling direction and the at least one deflectable arm engaging the proximal portion of the bulb to restrict movement of the cable contact in an opposite, uncoupling direction.

16. The electrical connector of claim 14, wherein the cable contact is loaded into the cavity of the housing prior to the center contact, the mating ends of the center and cable contacts connected by advancing the center contact through the cavity in a coupling direction until the attachment region surrounds the bulb, a first region of the bulb engaging a back wall at the mating end of the center contact to restrict further movement of the center contact in the coupling direction and a second region of the bulb engaging the at least one deflectable arm to restrict movement of the center contact in an opposite, uncoupling direction.

17. The electrical connector of claim 14, wherein the proximal portion of the bulb extends from a neck along a longitudinal axis of the cable contact, the neck having a diameter less than a diameter of the bulb, wherein the at least one deflectable arm is biased towards being received at least partially within the neck.

18. The electrical connector of claim 14, wherein the at least one deflectable arm extends from a back wall at the mating end of the center contact, the back wall oriented along a back wall axis, the at least one arm extending from a side edge of the back wall in an angle transverse to the back wall axis, the cap of the mating end extending from a distal end of the back wall in an angle transverse to the back wall axis.

19. The electrical connector of claim 18, wherein the at least one deflectable arm includes two deflectable arms that extend from opposite side edges of the back wall of the center contact, the two arms curved towards each other and together surround at least most of a perimeter of the bulb when the bulb is received within the attachment region.

20. The electrical connector of claim 14, wherein the at least one deflectable arm at the mating end of the center contact includes a flared end that flares radially outward away from the attachment region, the bulb at the mating end of the cable contact engaging the flared end of the at least one arm to deflect the at least one arm radially outward to permit the bulb to enter the attachment region as the mating ends of the center and cable contacts are connected.

* * * * *